US008893421B2

(12) United States Patent
Degidio

(10) Patent No.: US 8,893,421 B2
(45) Date of Patent: Nov. 25, 2014

(54) DUCKBILL STYLE SPREADER ATTACHMENT FOR A SHOTGUN

(71) Applicant: Paradigm SRP, LLC, Houston, TX (US)

(72) Inventor: Joseph Todd Degidio, Houston, TX (US)

(73) Assignee: Paradigm SRP, LLC, Houston, TX (US)

( * ) Notice: Subject to any disclaimer, the term of this patent is extended or adjusted under 35 U.S.C. 154(b) by 81 days.

(21) Appl. No.: 13/647,011

(22) Filed: Oct. 8, 2012

(65) Prior Publication Data

US 2014/0130391 A1 May 15, 2014

(51) Int. Cl.
*F41A 21/40* (2006.01)

(52) U.S. Cl.
CPC ..... *F41A 21/40* (2013.01)
USPC ..... 42/79

(58) Field of Classification Search
CPC ..... F41A 21/40; F41A 21/42
USPC ..... 42/79; 89/14.2, 14.3; D22/108
See application file for complete search history.

(56) References Cited

U.S. PATENT DOCUMENTS

| | | | | |
|---|---|---|---|---|
| 3,226,871 | A * | 1/1966 | Sargeant et al. | 42/79 |
| 3,676,947 | A * | 7/1972 | Ashbrook et al. | 42/79 |
| 3,698,747 | A * | 10/1972 | Wing et al. | 285/305 |
| 4,757,741 | A * | 7/1988 | Brothers | 89/14.05 |
| 5,452,535 | A * | 9/1995 | See et al. | 42/79 |
| 6,385,891 | B1 * | 5/2002 | Rabatin | 42/79 |
| 6,609,324 | B1 * | 8/2003 | Truitt, Jr. | 42/79 |
| 7,854,085 | B1 * | 12/2010 | Hodgkins et al. | 42/85 |
| 8,042,448 | B1 * | 10/2011 | Sylvester et al. | 89/14.3 |
| 8,490,534 | B1 * | 7/2013 | Moore | 89/14.2 |
| 2004/0154209 | A1 * | 8/2004 | Walker | 42/79 |
| 2005/0066802 | A1 * | 3/2005 | Meyers | 89/14.2 |
| 2012/0317853 | A1 * | 12/2012 | Butler | 42/1.06 |

* cited by examiner

*Primary Examiner* — Bret Hayes
(74) *Attorney, Agent, or Firm* — Conley Rose, P.C.

(57) ABSTRACT

A muzzle attachment for a shotgun is disclosed including a first portion that has a first end, a second end, a central axis extending from the first end to the second end, and a through bore extending from the first end to the second end, concentric about the axis. The muzzle attachment also includes a second portion having a pair of opposing extensions defining a gap therebetween. Each extension has a base adjacent the second end of the first portion and a distal end extending away from the base. Additionally, the gap has a narrow end adjacent the base, a wide end adjacent to the distal end, and a pair of opposing lateral sides extending along a projection of the axis. Each of the sides includes a webbing disposed at the narrow end; wherein each webbing has an inner surface, an outer surface, and a radial thickness which tapers from the narrow end to the wide end.

20 Claims, 11 Drawing Sheets

DUCKBILL STYLE SPREADER ATTACHMENT FOR A SHOTGUN

CROSS-REFERENCE TO RELATED APPLICATIONS

Not applicable.

STATEMENT REGARDING FEDERALLY SPONSORED RESEARCHED OR DEVELOPMENT

Not applicable.

BACKGROUND

Firearms have been used prominently worldwide for centuries for various applications such as military, personal protection, hunting, and recreation. A shotgun refers to a particular type of firearm which simultaneously fires multiple pellets with each discharge of the firearm. The arrangement in which these discharged pellets strike the target is most often referred to as the pattern of the shot.

Many devices (e.g., chokes) have been developed that alter the flight paths of pellets that are fired from a shotgun such that the pattern is smaller or larger than it would be without utilizing such a device. Other devices were developed specifically for the U.S. Navy Sea, Air, and Land Special Operations teams ("SEALs") during the U.S. war in Vietnam, which were designed to form an elongated pattern when the shotgun was discharged. These types of devices are generally referred to as duckbill chokes, because of their slight resemblance to a duck's bill. However, these devices have been plagued with reliability and durability issues. As a result, many individuals who have utilized such devices have experienced catastrophic failures due to their shortcomings.

SUMMARY

The present disclosure relates to a muzzle attachment for a shotgun that includes a first portion comprising: a first end, a second end, a central axis extending from the first end to the second end, and a through bore extending from the first end to the second end, concentric about the axis. The muzzle attachment also includes a second portion comprising a pair of opposing extensions defining a gap therebetween; wherein each extension has a base adjacent the second end of the first portion and a distal end extending away from the base, and the gap has a narrow end adjacent the base, a wide end adjacent to the distal end, and a pair of opposing lateral sides extending along a projection of the axis. Finally, each of the sides includes a webbing disposed at the narrow end; wherein each webbing has an inner surface, an outer surface, and a radial thickness which tapers from the narrow end to the wide end.

Some embodiments are directed to a muzzle attachment for a shotgun including a first portion comprising: a first end, a second end, a central axis extending from the first end to the second end, and a through bore extending from the first end to the second end, concentric about the axis. The muzzle attachment also includes a second portion comprising a pair of opposing extensions defining a gap therebetween; wherein each extension has a base adjacent the second end of the first portion and a distal end extending away from the base. Additionally, the gap has a narrow end adjacent the base, a wide end adjacent to the distal end, and a pair of opposing lateral sides extending along a projection of the axis. Finally, each of the extensions further comprises a plurality of teeth disposed on the distal end.

Other embodiments also are directed to a muzzle attachment for a shotgun including a first portion comprising: a first end, a second end, a central axis extending from the first end to the second end, and a through bore extending from the first end to the second end, concentric about the axis. The muzzle attachment also includes a second portion comprising a pair of opposing extensions defining a gap therebetween; wherein each extension has a base adjacent the second end of the first portion and a distal end extending away from the base. Additionally, the gap has a narrow end adjacent the base, a wide end adjacent to the distal end, and a pair of opposing lateral sides extending along a projection of the axis. Each of the sides includes a webbing disposed at the narrow end. Each webbing has an inner surface, an outer surface, and a radial thickness which tapers from the narrow end to the wide end. Further, the muzzle attachment also includes a threaded region extending from the first end of the first portion, at least one vent hole positioned on the surface of either the first portion of the second portion, and a plurality of teeth disposed on the distal end of each of the extension.

BRIEF DESCRIPTION OF THE DRAWINGS

For a detailed description of exemplary embodiments of the invention, reference will now be made to the accompanying drawings in which.

DETAILED DESCRIPTION

Figure 1:
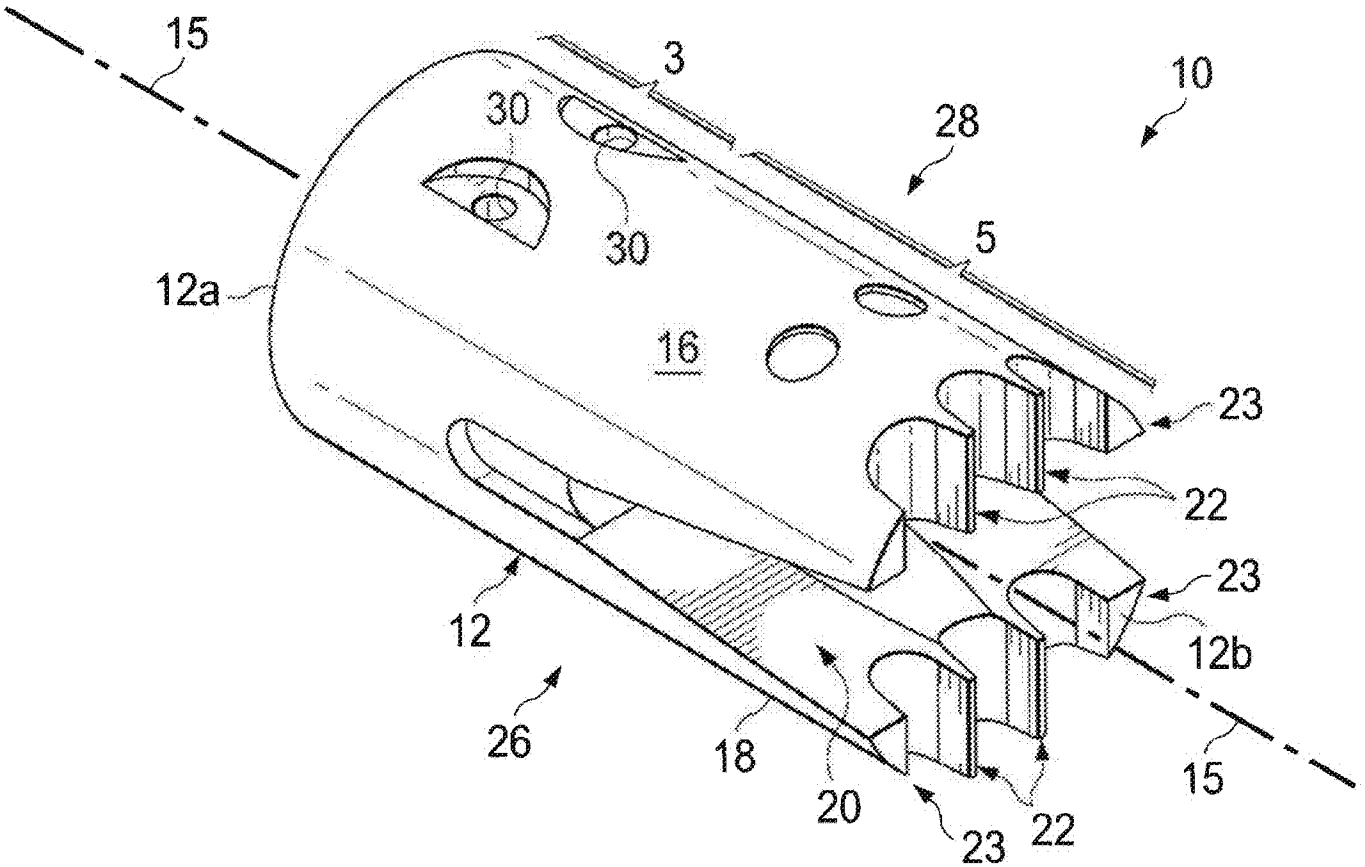
FIG. 1 shows a prospective view of a duckbill style shotgun attachment according to the principles of the current disclosure.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

As used herein, the word "approximately" means "plus or minus 10%."

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
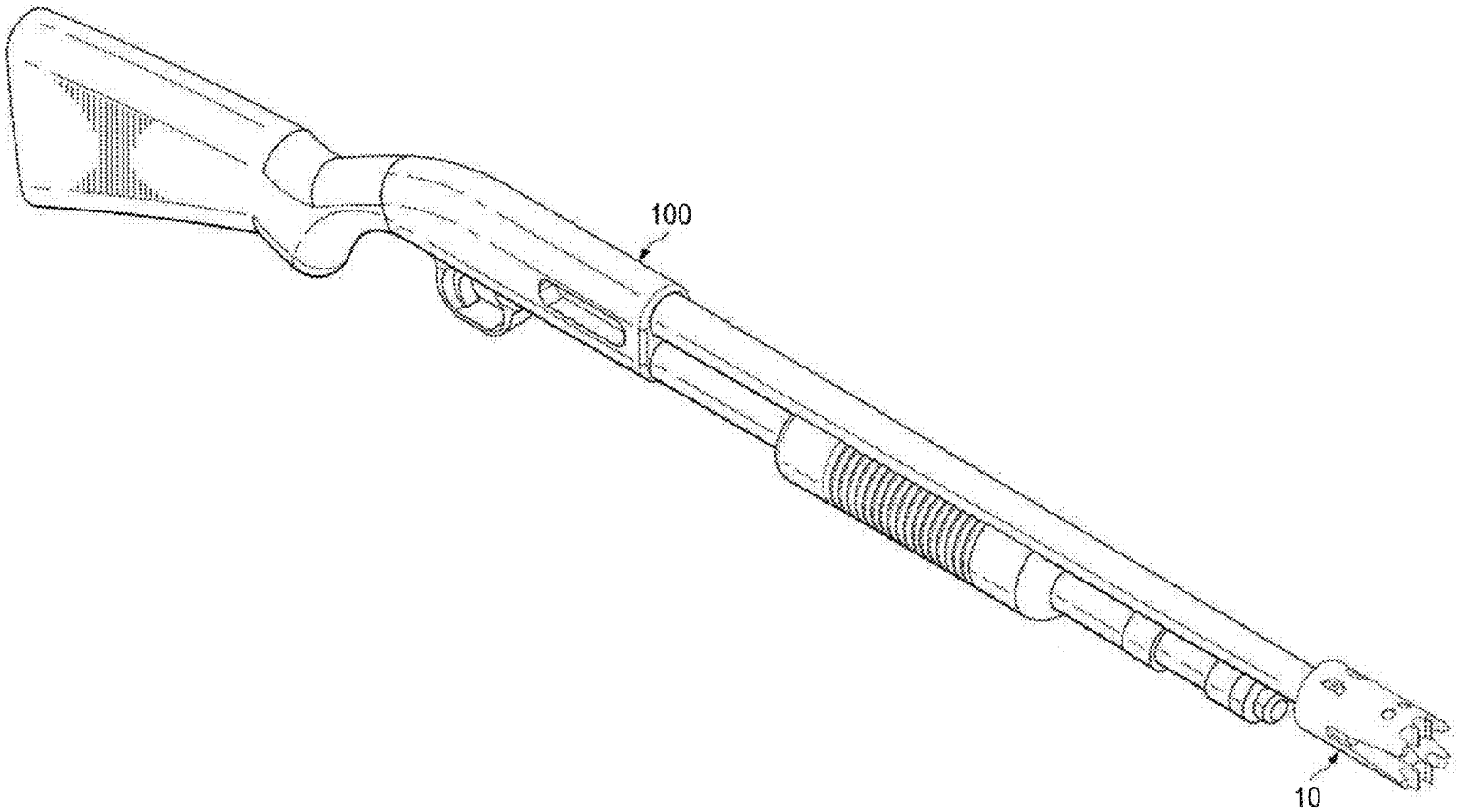
FIG. 2 shows a prospective view of the shotgun attachment of FIG. 1 attached to the muzzle of a shotgun.

Referring briefly to FIGS. 1 and 2, wherein prospective views of a gator or duckbill style shotgun attachment are shown according to the principles disclosed herein. As is best shown in FIG. 2 and as will be described in more detail below, attachment 10 may be coupled to the muzzle of a shotgun 100 such that pellets discharged from shotgun 100 are directed out of the muzzle and through the attachment 10.

Figure 3:
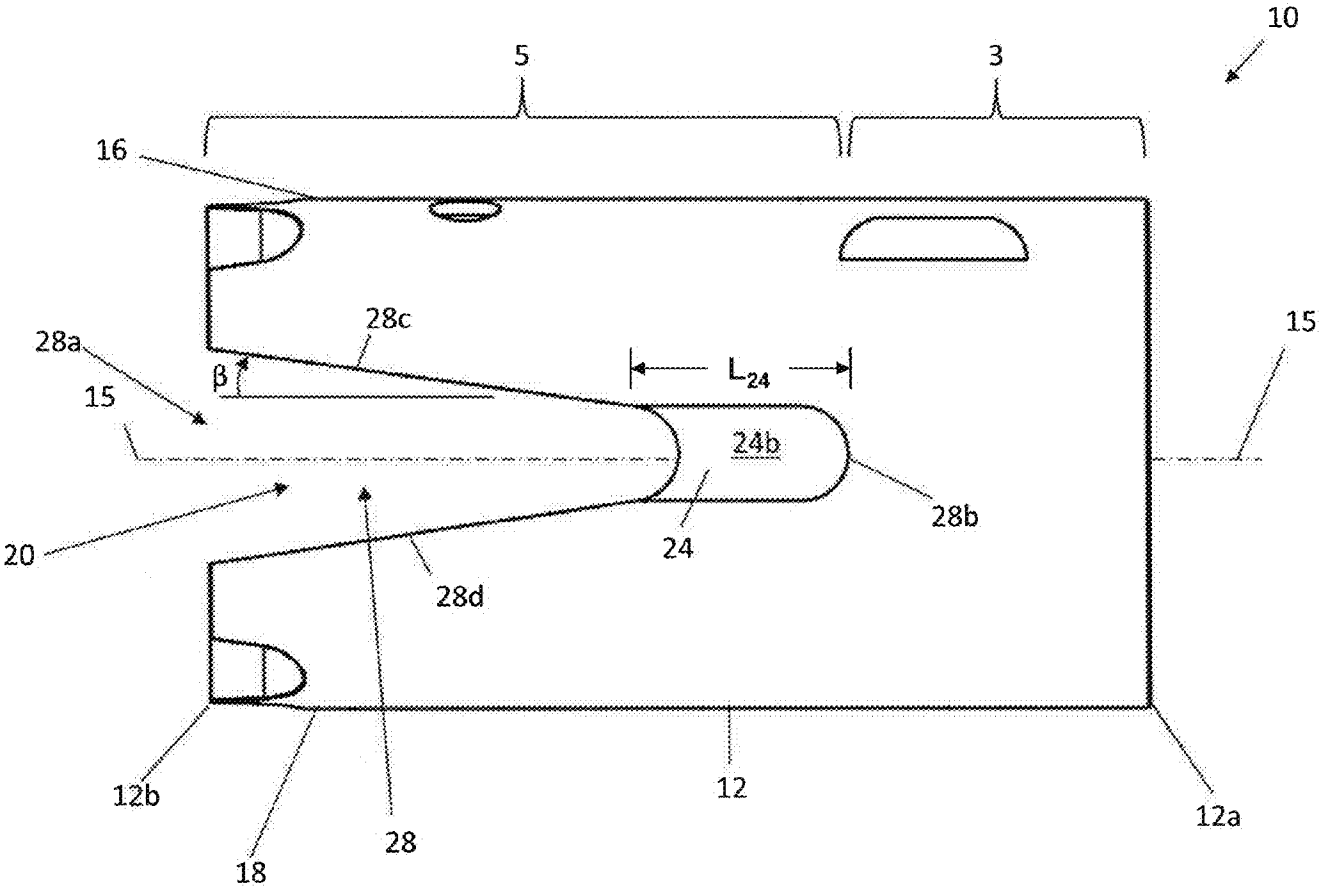
FIG. 3 shows a side view of the shotgun attachment of FIG. 1.

Referring now to FIGS. 1 and 3, wherein a prospective view and a side view of a duckbill style shotgun attachment 10 according to the principles of the current disclosure are shown. Duckbill style shotgun attachment 10 generally comprises a body 12, a first end 12*a*, a second end 12*b* opposite the first end 12*a*, a central longitudinal axis 15 extending from the first end 12*a* to the second end 12*b*. Additionally, attachment 10 comprises a first portion 3 extending from the first end 12*a*, and a second portion 5 extending from the first portion 3 to the second end 12*b*. In some embodiments the first portion 3 and the second portion 5 are monolithically formed such that they are formed as a single continuous piece. Additionally, in at least some embodiments, body 12 is constructed out of steel. However, any suitable material capable of withstanding the pressures exerted by the muzzle blast of a shotgun may be used while still complying with the principles of the current disclosure. For example, body 12 may be constructed out of stainless steel, titanium, or carbon fiber while still complying with the principles of the current disclosure.

Figure 6:
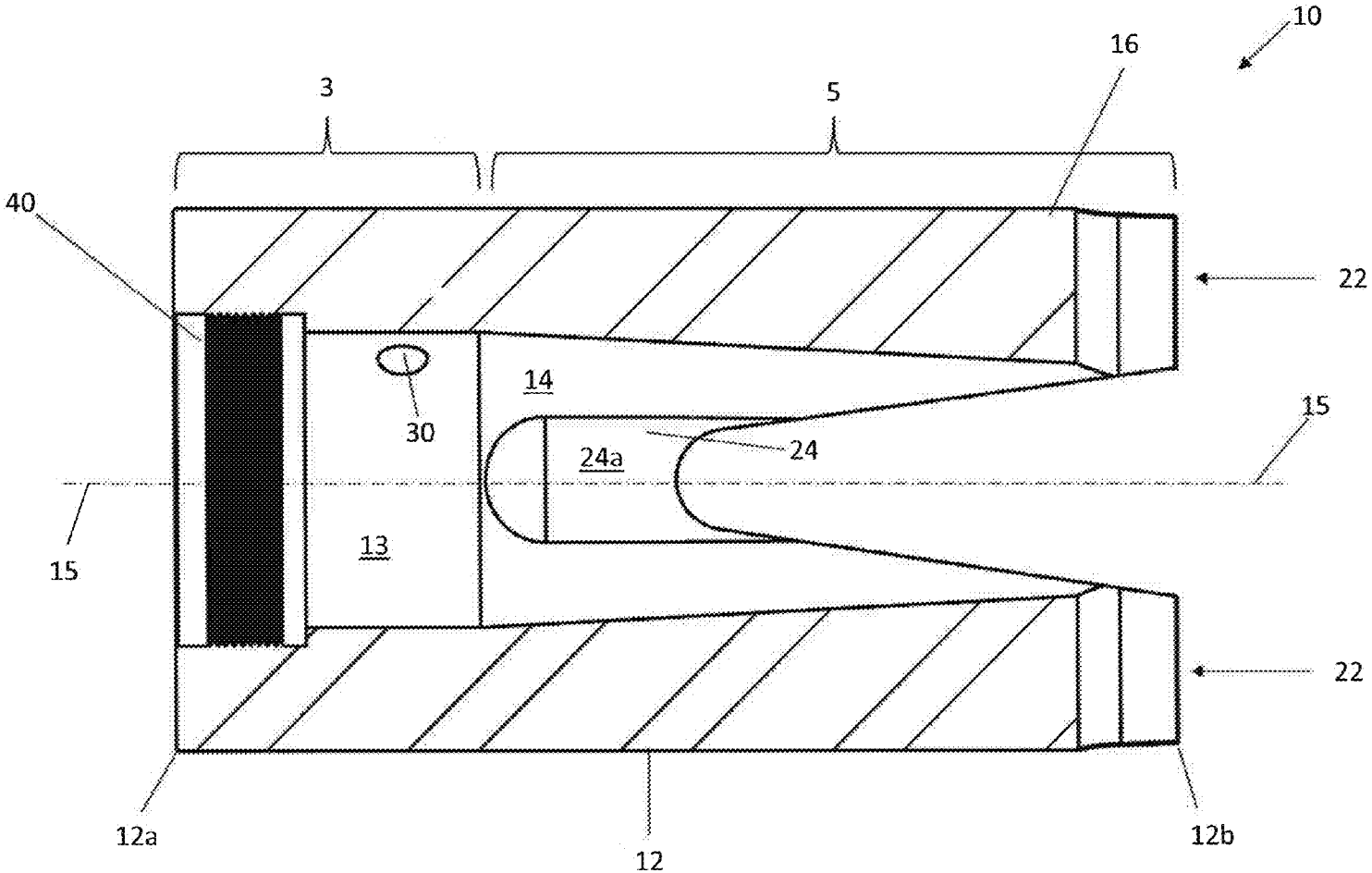
FIG. 6 is a cross-sectional view of section A-A in FIG. 4, illustrating the shotgun attachment of FIG. 1.

Referring briefly to FIG. 6, the first portion 3 comprises a through bore 13 extending from the first end 12*a* to the second portion 5 and concentric about axis 15. The second portion 5 similarly comprises a central passageway 14 extending from the first portion 3 to the second end 12*b* and concentric about axis 15. Additionally, the second portion 5 includes a pair of opposing lateral extensions 16, 18 extending substantially parallel to axis 15.

Referring back to FIGS. 1 and 3, opposing lateral extensions 16, 18 extend substantially parallel to axis 15 and define a gap 20 therebetween. Gap 20 includes a pair of substantially v-shaped opposing sides 26, 28. As is best shown in FIG. 3, side 28 has a wide end 28*a*, a narrow end 28*b*, an upper angled surface 28*c*, and a lower angled surface 28*d*. The upper and lower angled surfaces 28*c, d* are oriented at an angle β relative to axis 15. Angle β may exist within a wide range while still complying with principles of the current disclosure. For example, angle β is preferably between 0° and 15°, more preferably between 0° and 10°, and is most preferably 6°. Side 26 is substantially similar to side 28. As a result, a detailed description regarding side 26 has been omitted; however, one skilled in the art will understand that the description above relating to side 28 can be applied to fully describe side 26 in the same manner.

Figure 4:
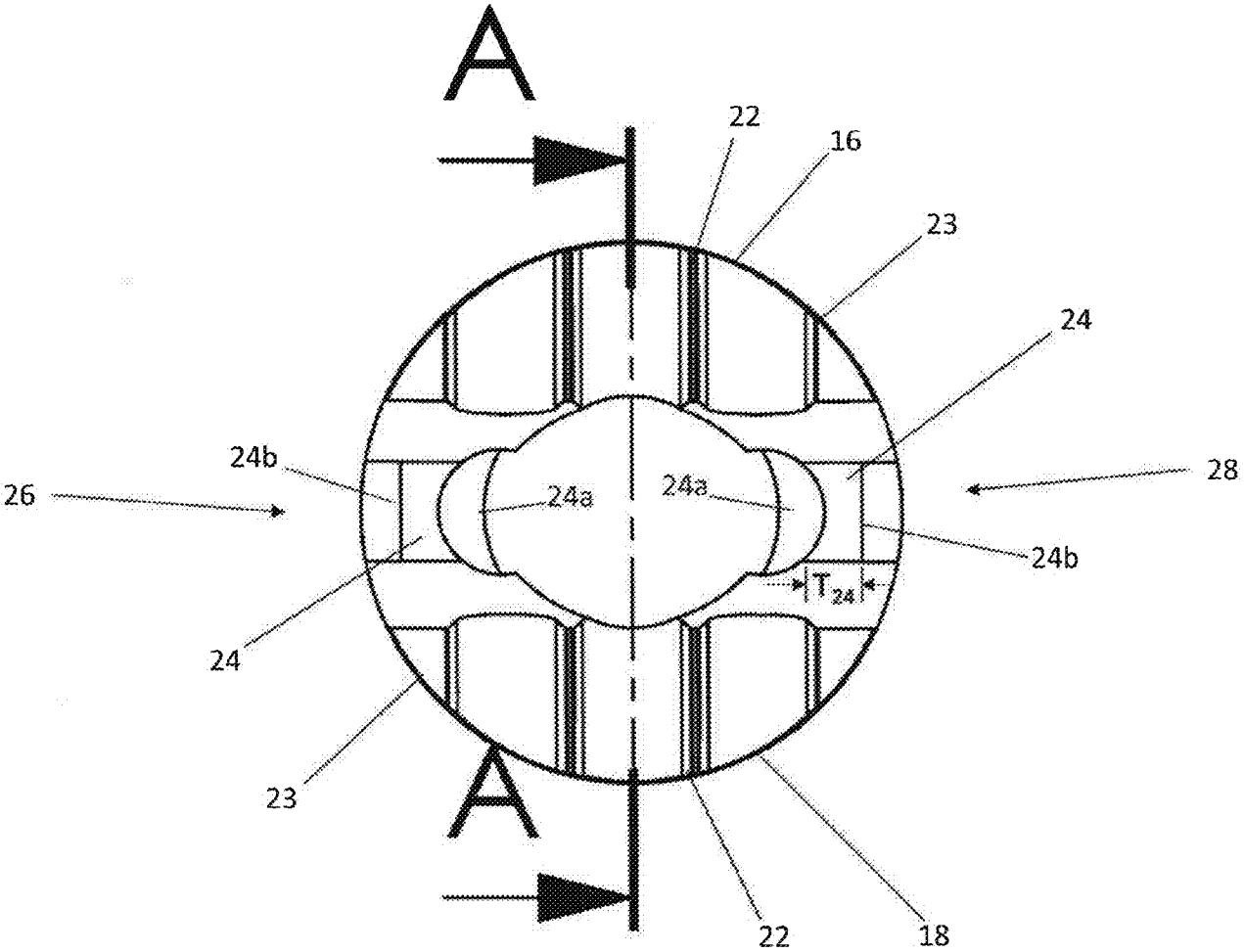
FIG. 4 shows a front view of the shotgun attachment of FIG. 1.

Referring now to FIGS. 3 and 4, a reinforcement webbing 24 is disposed at the narrow end (e.g., 28*b*) of each side 26, 28, and extends between the upper and lower angled surfaces of each side 26, 28 (e.g., between 28*c, d* in FIG. 2). Webbing 24 has an inner surface 24*a*, an outer surface 24*b*, an axial length $L_{24}$ measured along axis 15, and a radial thickness $T_{24}$ measured radially to axis 15 between surfaces 24*a, b*. Radial thickness $T_{24}$ tapers along the length $L_{24}$ of webbing 24 from the narrow end of each side 26, 28 (e.g., narrow end 28*b*). In some embodiments, webbing 24 is constructed out of the same material as body 12. However, webbing 24 may be constructed out of a different material than body 12 while still complying with the principles of the current disclosure. Also, in some embodiments webbing 24 may be welded into the gap 20 between the opposing lateral extensions 16, 18 or may be formed by milling or cutting the body 12 of attachment 10. Webbing 24 provides additional strength to attachment 10 such that when the attachment is disposed on the end of a shotgun (e.g., shotgun 100 shown in FIG. 2) that is being discharged, the forces exerted on the attachment by the gas expanding out of the muzzle can be absorbed by webbing 24. As a result, webbing 24 greatly reduces the risk of catastrophic failures that have been experienced in similar attachments.

Further, as is best shown in FIG. 4, the inner surface 24*a* of each webbing 24 is substantially concave. The concave inner surface 24*a*, when combined with the tapered radial thickness $T_{24}$ of webbing 24, allows the discharged pellets from the attached shotgun to gradually expand to the desired shot pattern without unnecessarily constricting the flight path of the pellets as they exit the muzzle of the shotgun (e.g., shotgun 100 shown in FIG. 2) and the attachment 10.

Figure 5:
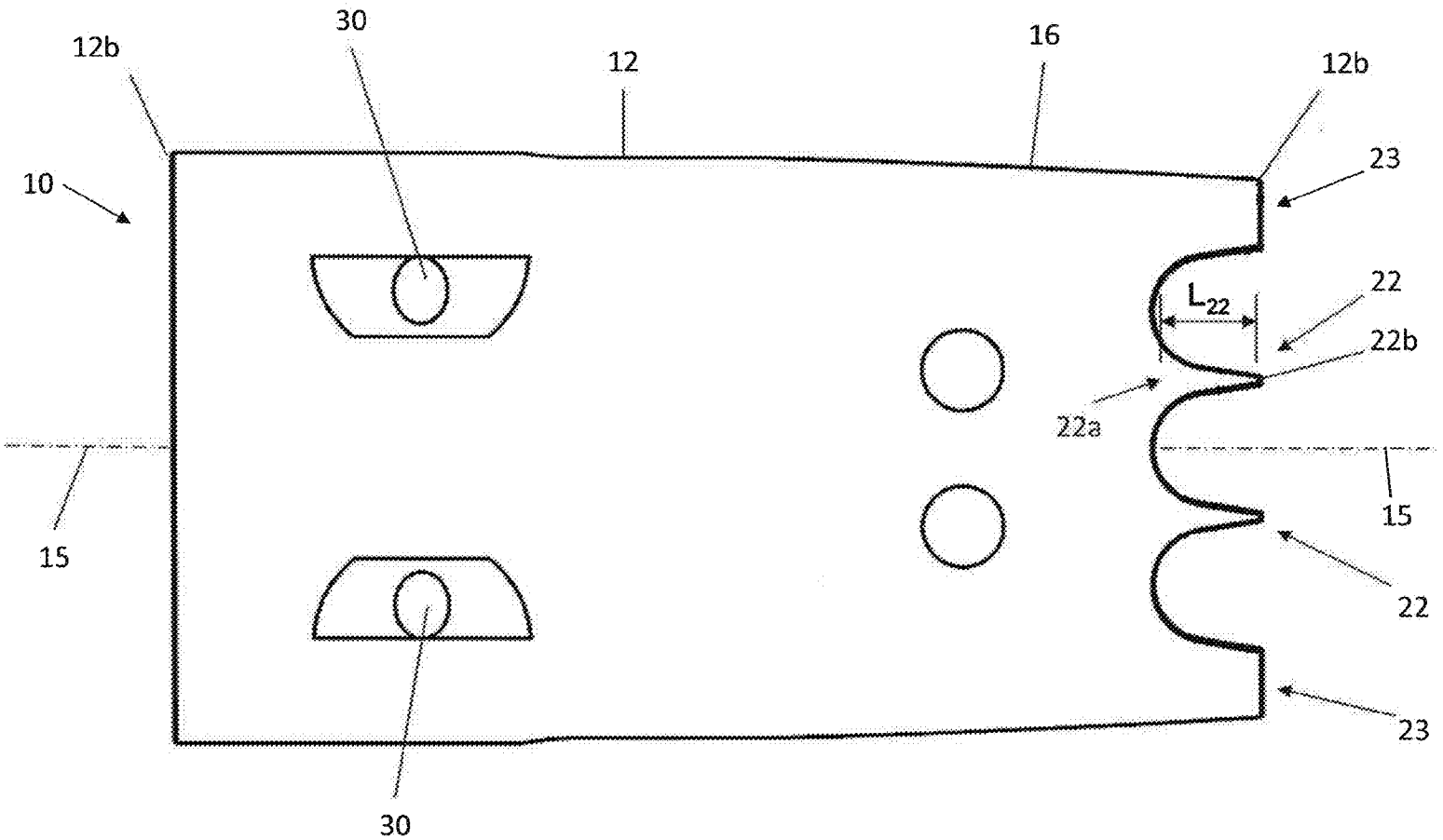
FIG. 5 is a top view of the shotgun attachment of FIG. 1.

Referring now to FIGS. 1 and 5, in the current embodiment, each of the opposing lateral extensions 16, 18 also include a plurality of teeth 22 disposed on the second end 12*b* of body 12. Teeth 22 are shown to be substantially triangular in shape and extend outward from the distal end of each opposing lateral extension 16, 18 in a direction substantially parallel to axis 15. However, teeth 22 may have other shapes while still complying with the principles of the current disclosure.

As is best shown in FIG. 5, in the current embodiment each opposing lateral extension 16, 18 has two teeth 22 extending between two blunt surfaces 23. However, it should be noted that the number and arrangement of the teeth 22 and blunt surfaces 23 may be varied while still complying with the principles of the current disclosure. Each tooth 22 has a base 22*a*, a distal tip 22*b*, and an axial length $L_{22}$ measured from the base 22*a* to the tip 22*b*. Teeth 22 may vary in size while still complying with the basic principles disclosed herein. For example, axial length $L_{22}$ of teeth 22 is preferably between 0.0625 in. and 1.0 in., more preferably between 0.0625 in. and 0.75 in., and is most preferably 0.125 in.

Teeth 22 serve multiple purposes. For example, teeth 22 may aid in breaching a doorway with an attached shotgun (e.g., shotgun 100 shown in FIG. 2). Specifically, teeth 22 may be driven into the surface of a locked or closed door at the desired point of breaching such that the attached shotgun is securely held in place on the door via teeth 22. The shotgun is then discharged allowing pellets to be driven into the door at the desired point thereby allowing the shooter to breach the closed or locked door and gain entry to the room or space beyond. Further, the open spaces between each tooth 22 provide paths from which gases expanding from the muzzle of the shotgun may escape when the shotgun is discharged against a door in the manner described above. Without these open flow paths, the discharged gases would not be allowed to properly vent during such a discharge, thereby potentially over pressuring the attachment 10 and the shotgun barrel. Additionally, teeth 22 may be utilized against a hostile person or animal in that the user may strike the hostile entity with teeth 22 when attachment 10 is coupled to the muzzle of a shotgun as is shown in FIG. 2. It should be noted that other embodiments of a duckbill shotgun attachment may not include teeth 22 while still complying with the principles of the current disclosure.

Referring again to FIGS. 1 and 5, in some embodiments body 12 further includes a pair of vent holes 30 is disposed on the top surface of body 12. In the embodiment shown, vent holes 30 are substantially cylindrical in cross-section; however, it should be understood that multiple shapes may be used while still complying with the general principles of the current disclosure. For example, vent holes 30 may have a cross-section that is square, rectangular, elliptical, octagonal, or hexagonal while still complying with the principles of the current disclosure. As is best shown in FIG. 6, vent holes 30 extend through the body 12 such that they open up into through bore 13. When an attached shotgun (not shown) is discharged, the expanding gases are forced into the through bore 13 of attachment 10. A portion of these expanding gases is then directed up through the vent holes 30. This redirection of a portion of the gases expanding from the muzzle of the shotgun reduces the recoil and the amount of "muzzle jump" experienced by the shooter. It should also be noted that other embodiments of a gator or duckbill style shotgun attachment may not include vent holes 30 while still complying with the principles of the current disclosure.

FIG. 6 shows a side cross-section of attachment 10. In some embodiments, attachment 10 may include a threaded region 40 disposed in the through bore 13 of the first portion 3 and extending axially from the first end 12*a* of body 12. As will be described in more detail below, threaded region 40 is configured to couple to either the external threads of a shotgun choke or the external threads disposed on the outer surface of the shotgun barrel.

Figure 7:
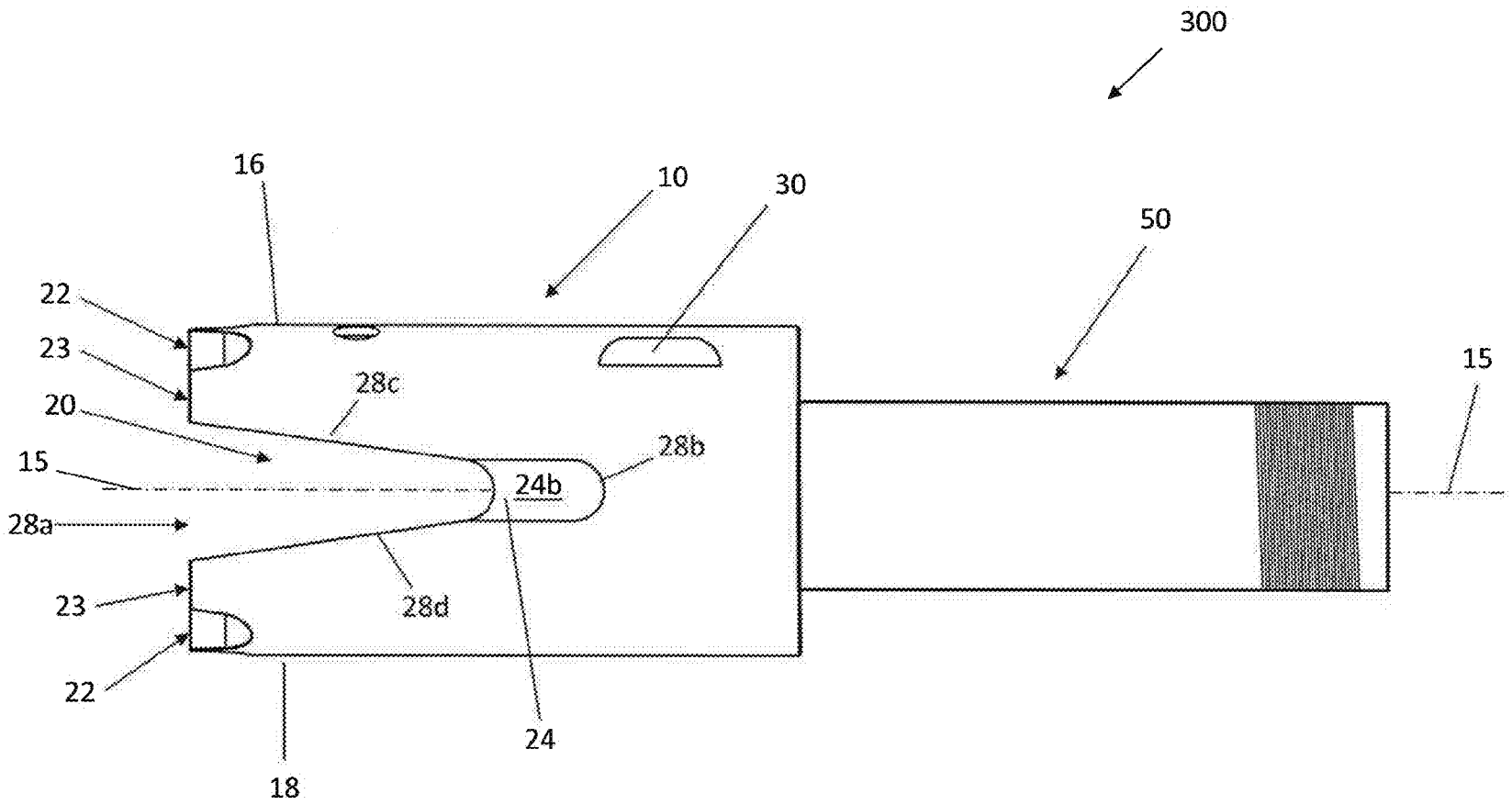
FIG. 7 is a side view of a system for attaching a duckbill style shotgun attachment to a shotgun barrel according to the principles of the current disclosure.
Figure 8:
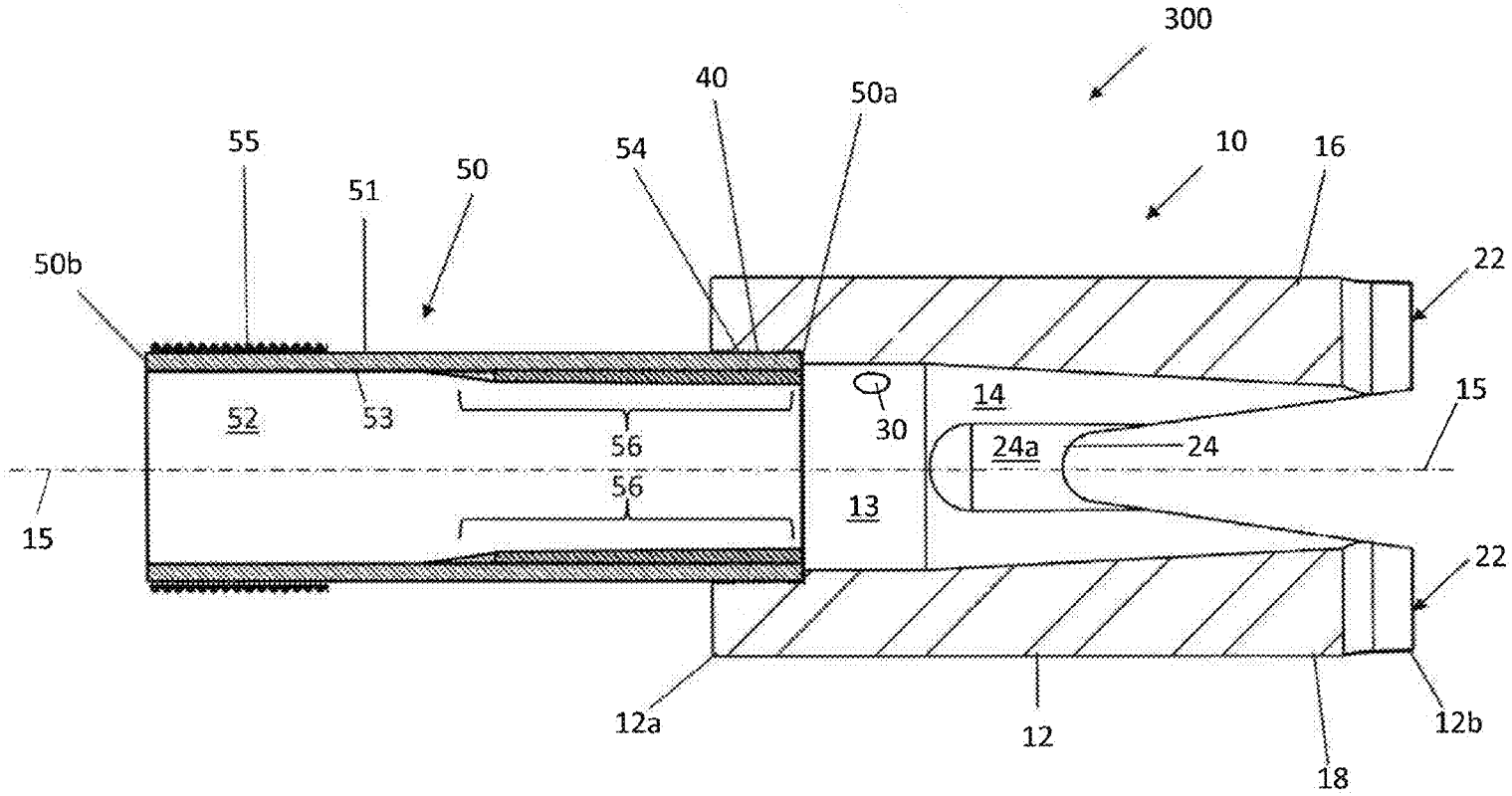
FIG. 8 is side cross-sectional view of the system for attaching a duckbill style shotgun attachment to a shotgun barrel shown in FIG. 7.
Figure 9:
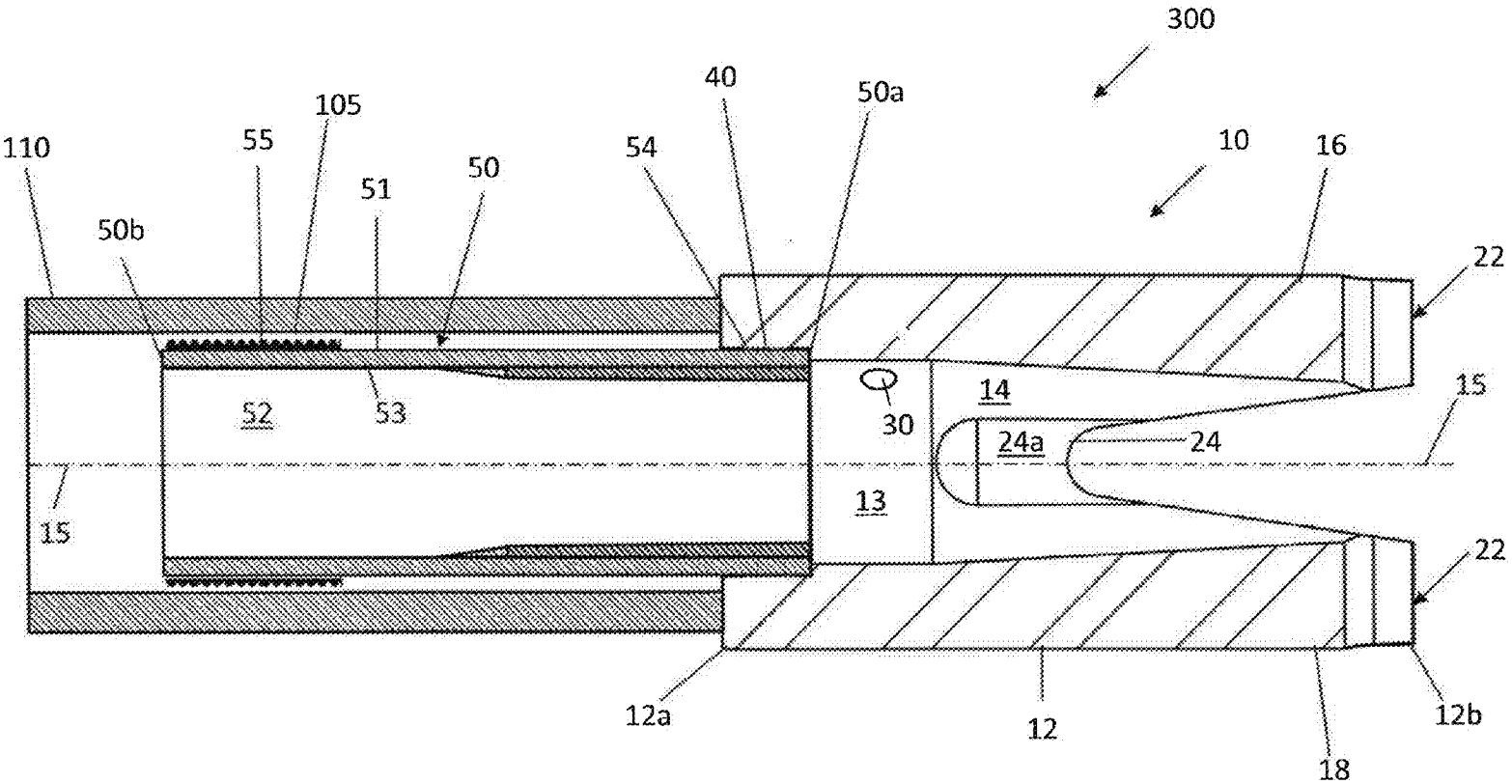
FIG. 9 is a side cross-sectional view of the system shown in FIGS. 7 and 8 coupled to a shotgun barrel.

Referring now to FIGS. 7-9, a side view and two side cross-sectional views of a system 300 for coupling attachment 10 to a shotgun barrel 110 are shown. System 300 generally comprises a duckbill shotgun attachment 10, previously described, and a shotgun choke 50.

Referring now to FIG. 8, shotgun choke 50 is substantially cylindrical in shape and has a first end 50*a*, a second end 50*b*, an outer surface 51, an inner surface 53, and a central through bore 52. The inner surface 53 includes a restrictor region 56 that restricts the inner diameter of choke 50 such that the flight paths of pellets that are discharged from a shotgun (not shown) are restricted before exiting the barrel. However, it should be noted that other embodiments of choke 50 may not include restrictor region 56 while still complying with the principles of the current disclosure. Additionally, choke 50 has a first threaded region 55 disposed on the outer surface 51 extending from the second end 50*b* and a second threaded region 54 disposed on the outer surface 51 extending from the first end 50*a*.

Referring to FIGS. 8 and 9, in order to couple choke 50 to attachment 10, the second threaded region 54 is engaged with the threaded region 40 of attachment 10, such that through bore 52 is concentrically aligned with both through bore 13 and central passageway 14 of attachment 10. As is shown in FIG. 9, in order to couple system 300 to a shotgun barrel 110 having threads 105 disposed on its inner surface, the first threaded region 55 is engaged with the internal threads 105 of shotgun barrel 110 such that barrel 110 is concentrically aligned with choke 50 and attachment 10.

Figure 10:
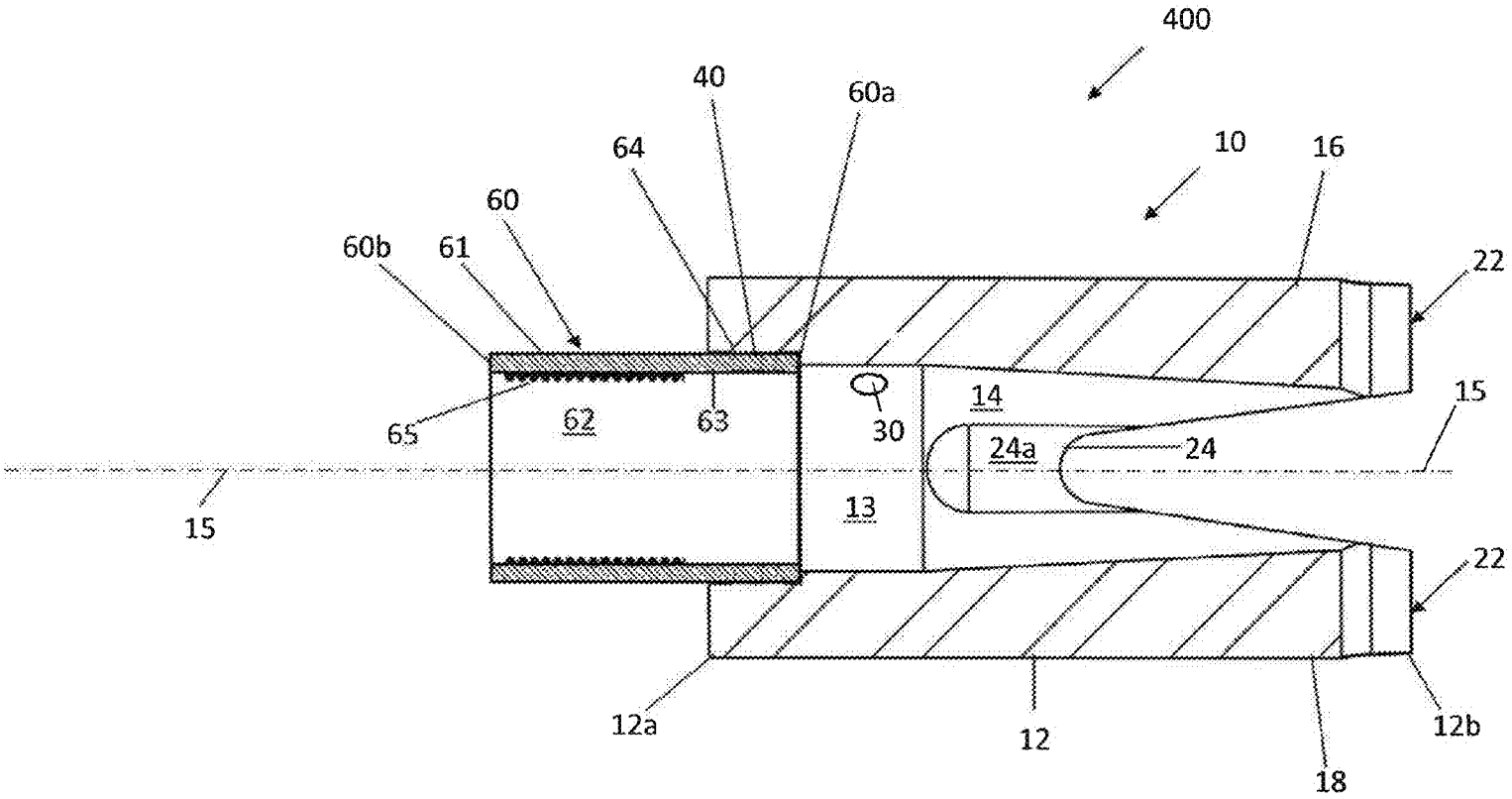
FIG. 10 is a side cross sectional view of another system for attaching a duckbill shotgun attachment to a shotgun barrel according to the principles of the current disclosure.
Figure 11:
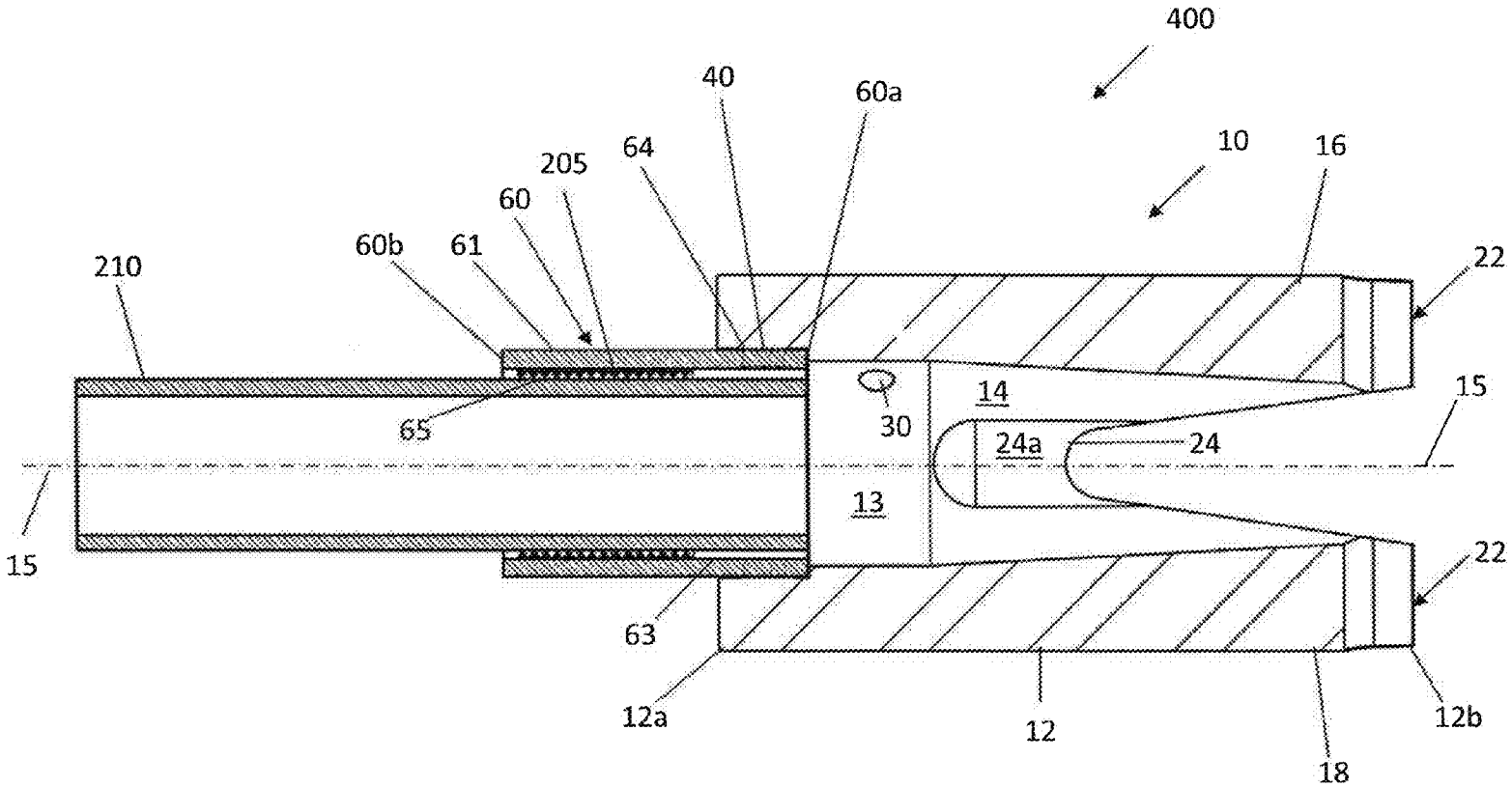
FIG. 11 is a side cross-sectional view of the system shown in FIG. 10 coupled to a shotgun barrel.

Referring now to FIGS. 10 and 11, a side cross-sectional view of another system 400 for coupling a duckbill attachment 10 to a shotgun barrel 210 is shown. System 400 generally comprises a duckbill shotgun attachment 10, previously described, and an adapter 60.

Adapter 60 is substantially cylindrical in shape and has a first end 60*a*, a second end 60*b*, an outer surface 61, an inner surface 63, and a central through bore 62. Additionally, adapter 60 includes an outer threaded region 64 disposed on the outer surface 61 and an inner threaded region 65 disposed on the inner surface 63.

In order to couple attachment 10 to adapter 60, the outer threaded region 64 of adapter is engaged with the threaded region 40 of attachment 10 such that through bore 62 is concentrically aligned with both through bore 13 and central passageway 14 of attachment 10. As is shown in FIG. 11, in order to couple system 400 to a shotgun barrel 210 having threads 205 disposed on its outer surface, the first threaded region 65 is engaged with the external threads 205 of shotgun barrel 110 such that barrel 210 is concentrically aligned with adapter 60 and attachment 10. In other embodiments, the threaded region 40 of the duckbill shotgun attachment 10 may be configured to engage directly with the external threads 205 of shotgun barrel 210 while still complying with the principles of the current disclosure.

A typical shotgun pattern is substantially circular. Therefore, with each discharge from a typical shotgun, pellets are evenly distributed within a substantially circular area when they strike the target or targets. A shotgun with a duckbill attachment made according to the principles of the current disclosure attached thereto will produce a shot pattern that is substantially elongated relative to the typical shot pattern produced by that shotgun without utilizing such a duckbill attachment. Specifically, when employing an attachment made according to the principles of the current disclosure (e.g., attachment 10), pellets may be evenly distributed within a substantially elliptical area when they strike the target or targets. For example, a typical 12 gauge shotgun coupled to a duckbill attachment made according to the principles of the current disclosure may produce a shot pattern that is as long as 6 feet at a distance of approximately 20 yards. However, the above figures may vary greatly based on several factors including but not limited to the type of ammunition, the type of shotgun, and the environmental conditions.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A muzzle attachment for a shotgun, the muzzle attachment having a central axis and comprising:

a first portion including a first end, a second end, and a through bore extending axially from the first end to the second end, wherein the through bore is concentric about the central axis; and a second portion including a pair of extensions disposed radially opposite one another across the central axis and defining a gap therebetween, the second portion being configured to form a plurality, of simultaneous fired projectiles that pass therethrough into an elliptical pattern;

wherein each extension has a base adjacent the second end of the first portion and a distal end extending away from the base;

wherein the gap has a narrow end adjacent the base, a wide end adjacent to the distal end, and a pair of opposing lateral sides;

wherein each of the sides includes a webbing disposed at the narrow end; and wherein each webbing has an inner surface, an outer surface, and a radial thickness which tapers from the narrow end toward the wide end.

2. The muzzle attachment of claim 1 wherein the inner surface of each webbing is concave.

3. The muzzle attachment of claim 1 wherein the first portion further comprises a threaded region extending from the first end.

4. The muzzle attachment of claim 3 wherein the threaded region is configured to couple to a shotgun choke.

5. The muzzle attachment of claim 3 wherein the threaded region is configured to couple to an adapter which in turn is configured to couple to a shotgun barrel.

6. The muzzle attachment of claim 3 wherein the threaded region is configured to couple to a shotgun barrel.

7. The muzzle attachment of claim 1 further comprising a vent hole positioned on the surface of either the first portion of the second portion.

8. The muzzle attachment of claim 1 wherein each of the extensions further comprises a plurality of teeth disposed on the distal end.

9. The muzzle attachment of claim 1, wherein the lateral sides of the gap are disposed radially opposite one another across the central axis.

10. A muzzle attachment for a shotgun, the muzzle attachment having a central axis, a first end, a second end opposite the first end, and comprising:

a first portion extending from the first end, and including a through bore extending axially from the first end, wherein the through bore is concentric about the central axis; and a second portion extending axially from the first portion to the second end and including an outer surface and a pair of extensions defining a gap in the outer surface of the second portion, the second portion being configured to form a plurality of simultaneously fired projectiles that pass therethrough into an elliptical pattern;

wherein each of the extensions includes an inner ramped surface that tapers radially inward toward the central axis while extending axially from the first portion;

wherein each extension has a base adjacent the second end of the first portion and a distal end extending away from the base;

wherein the gap has a narrow end adjacent the base, a wide end adjacent to the distal end, and a pair of opposing lateral sides;

wherein each of the sides includes a webbing disposed at the narrow end;

wherein each webbing has an inner surface, an outer surface, and a radial thickness which tapers from the narrow end toward the wide end; and wherein the outer surface of each webbing is positioned radially inward from the outer surface of the second portion.

11. The muzzle attachment of claim 10 wherein the first portion further comprises a threaded region extending from the first end.

12. The muzzle attachment of claim 11 wherein the threaded region is configured to couple to a shotgun choke.

13. The muzzle attachment of claim 11 wherein the threaded region is configured to couple to an adapter which in turn is configured to couple to a shotgun barrel.

14. The muzzle attachment of claim 11 wherein the threaded region is configured to couple to a shotgun barrel.

15. The muzzle attachment of claim 10 further comprising a vent hole positioned on the surface of either the first portion of the second portion.

16. The muzzle attachment of claim 10 wherein each of the extensions further includes a plurality of teeth disposed on the distal end.

17. A muzzle attachment for a shotgun, the muzzle attachment having a central axis, a first end, a second end opposite the first end, and comprising:

a first portion extending from the first end and including a through bore extending axially from the first end, wherein the through bore is concentric about the central axis; and a second portion extending axially from the first ion to the second end and including:

an outer surface;

a pair of extensions disposed radially opposite one another across the central axis and defining a gap in the radially outer surface of the second portion, wherein each of the extensions includes an inner ramped surface that tapers radially inward toward the central axis while extending axially from the first portion;

wherein each extension has a base adjacent the second end of the first portion and a distal end extending away from the base;

wherein the gap has a narrow end adjacent the base, a wide end adjacent to the distal end, and a pair of opposing lateral sides;

wherein each of the sides includes a webbing disposed at the narrow end;

wherein each webbing has an inner surface, an outer surface, and a radial thickness which tapers from the narrow end to the wide end;

wherein the outer surface of each webbing is positioned radially inward from the outer surface of the second portion; and wherein the second portion is configured to form a plurality of simultaneously fired projectiles that pass therethrough into an elliptical pattern.

18. The muzzle attachment of claim 17, further comprising:

a threaded region extending from the first end of the first portion;

at least one vent hole positioned on the surface of either the first portion or the second portion; and a plurality of teeth disposed on the distal end of each of the first extension and the second extension.

19. The attachment of claim 18 wherein the threaded region is configured to couple to a shotgun choke.

20. The muzzle attachment of claim 18 wherein the threaded region is configured to couple to a shotgun barrel.

* * * * *